US009090836B2

(12) United States Patent
Brown et al.

(10) Patent No.: US 9,090,836 B2
(45) Date of Patent: Jul. 28, 2015

(54) UPGRADING HYDROCARBON PYROLYSIS PRODUCTS

(75) Inventors: Stephen H. Brown, Annandale, NJ (US); S. Mark Davis, Humble, TX (US); Teng Xu, Houston, TX (US); Keith G. Reed, Houston, TX (US); Ananthakrishnan Bhasker, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 374 days.

(21) Appl. No.: 13/601,207

(22) Filed: Aug. 31, 2012

(65) Prior Publication Data

US 2013/0233764 A1 Sep. 12, 2013

Related U.S. Application Data

(60) Provisional application No. 61/529,565, filed on Aug. 31, 2011, provisional application No. 61/529,588, filed on Aug. 31, 2011, provisional application No. 61/657,299, filed on Jun. 8, 2012.

(51) Int. Cl.

| | |
|---|---|
| ***C10L 1/00*** | (2006.01) |
| ***H01B 3/22*** | (2006.01) |
| ***C10G 69/06*** | (2006.01) |
| ***C10G 49/18*** | (2006.01) |

(52) U.S. Cl.

CPC ..... *C10G 69/06* (2013.01); *C10G 49/18* (2013.01)

(58) Field of Classification Search

CPC ..... C10G 69/06; C10G 49/18
USPC ..... 208/14, 108, 68
See application file for complete search history.

(56) References Cited

U.S. PATENT DOCUMENTS

| | | | | |
|---|---|---|---|---|
| 3,617,493 | A * | 11/1971 | Wirth et al. | 208/80 |
| 3,817,853 | A | 6/1974 | Folkins | |
| 4,173,529 | A | 11/1979 | Bauer | |
| 4,846,958 | A | 7/1989 | Feldman et al. | |
| 5,069,775 | A | 12/1991 | Grosboil | |
| 5,158,668 | A | 10/1992 | Chahar et al. | |
| 5,215,649 | A | 6/1993 | Grenoble et al. | |
| 5,370,787 | A | 12/1994 | Forbus, Jr. | |
| 5,871,634 | A | 2/1999 | Wiehe et al. | |
| 7,578,929 | B2 | 8/2009 | Stell et al. | |
| 8,083,931 | B2 | 12/2011 | McCoy et al. | |
| 2007/0007170 | A1 | 1/2007 | Strack et al. | |
| 2007/0090018 | A1 | 4/2007 | Keusenkothen et al. | |
| 2007/0163921 | A1 | 7/2007 | Keusenkothen et al. | |
| 2009/0057200 | A1 | 3/2009 | Leta et al. | |
| 2009/0272671 | A1 * | 11/2009 | Keusenkothen | 208/44 |
| 2010/0326887 | A1 | 12/2010 | McGehee et al. | |
| 2011/0005970 | A1 | 1/2011 | Ou et al. | |
| 2011/0180456 | A1 * | 7/2011 | Davis et al. | 208/61 |

FOREIGN PATENT DOCUMENTS

| | | |
|---|---|---|
| GB | 1159843 | 7/1969 |
| GB | 2 194 794 | 3/1988 |
| GB | 2194794 | 3/1988 |

* cited by examiner

*Primary Examiner* — Randy Boyer
*Assistant Examiner* — Juan Valencia

(57) ABSTRACT

The invention relates to upgraded pyrolysis products, processes for upgrading products obtained from hydrocarbon pyrolysis, equipment useful for such processes, and the use of upgraded pyrolysis products.

24 Claims, 1 Drawing Sheet

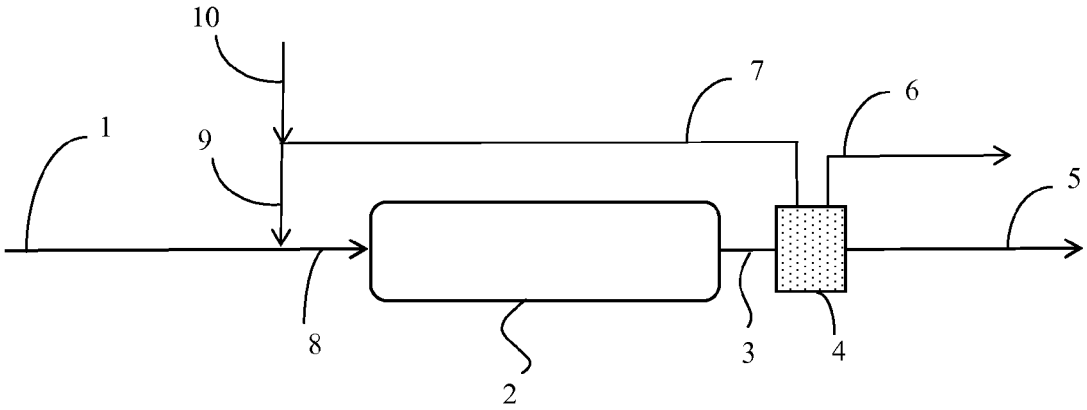
10
7
6
1
9
5
8
2
3
4

UPGRADING HYDROCARBON PYROLYSIS PRODUCTS

CROSS-REFERENCE TO RELATED APPLICATIONS

This application claims the benefit of and priority to U.S. Provisional Application No. 61/529,565, filed Aug. 31, 2011, U.S. Provisional Application No. 61/529,588, filed on Aug. 31, 2011, and U.S. Provisional Application No. 61/657,299, filed Jun. 8, 2012, the entireties of which are incorporated herein by reference.

FIELD

The invention relates to upgraded pyrolysis products, processes for upgrading products obtained from hydrocarbon pyrolysis, equipment useful for such processes, and the use of upgraded pyrolysis products.

BACKGROUND

Pyrolysis processes such as steam cracking can be utilized for converting saturated hydrocarbon to higher-value products such as light olefin, e.g., ethylene and propylene. Besides these useful products, hydrocarbon pyrolysis can also produce a significant amount of relatively low-value products such as steam-cracker tar ("SCT").

One conventional SCT-upgrading process involves catalytically hydroprocessing the SCT in order to crack the SCT molecules. The process can be operated at a temperature in the range of from 250° C. to 380° C., at a pressure in the range of 5400 kPa to 20,500 kPa, using catalysts containing one or more of Co, Ni, or Mo; but significant catalyst coking is observed. Although catalyst coking can be lessened by operating the process at an elevated hydrogen partial pressure, diminished space velocity, and a temperature in the range of 200° C. to 350° C.; SCT hydroprocessing under these conditions is undesirable because increasing hydrogen partial pressure worsens process economics, as a result of increased hydrogen and equipment costs, and because the elevated hydrogen partial pressure, diminished space velocity, and reduced temperature range favor undesired hydrogenation reactions.

SUMMARY

In an embodiment, the invention relates to a hydrocarbon conversion process, comprising:

(a) providing a first mixture comprising ≥10.0 wt. % hydrocarbon based on the weight of the first mixture;

(b) exposing the first mixture to a temperature ≥400° C. under pyrolysis conditions to produce a second mixture comprising ≥1.0 wt. % of $C_2$ unsaturates, and ≥0.1 wt. % of Tar Heavies, the weight percents being based on the weight of the second mixture;

(c) separating from the second mixture a third mixture comprising ≥10.0 wt. % of the second mixture's Tar Heavies based on the weight of the second mixture's Tar Heavies;

(d) providing a utility fluid, the utility fluid comprising aromatics and having an ASTM D86 10% distillation point ≥60.0° C. and a 90% distillation point ≤350.0° C.; and (e) contacting the third mixture with at least one hydroprocessing catalyst under catalytic hydroprocessing conditions in the presence of molecular hydrogen and the utility fluid to convert at least a portion of the third mixture to a hydroprocessed product, wherein (i) the hydroprocessed product has a viscosity less than that of the third mixture and (ii) the hydroprocessing has a coke yield ≤0.1 wt. % based on the weight of the third mixture.

In another embodiment, the invention relates to a hydrocarbon conversion process, comprising:

(a) providing a hydrocarbon mixture comprising ≥1.0 wt. % of $C_2$ unsaturates, and ≥0.1 wt. % of Tar Heavies, the weight percents being based on the weight of the second mixture;

(b) combining the hydrocarbon mixture with a utility fluid to produce a feed mixture, the utility fluid comprising aromatics and having an ASTM D86 10% distillation point ≥60.0° C. and a 90% distillation point ≤350.0° C., wherein the feed mixture comprises 20.0 wt. % to 95.0 wt. % of the hydrocarbon mixture and 5.0 wt. % to 80.0 wt. % of the utility fluid based on the weight of the feed mixture; and (c) contacting the feed mixture with at least one hydroprocessing catalyst under catalytic hydroprocessing conditions in the presence of molecular hydrogen to convert at least a portion of the feed mixture to a hydroprocessed product, wherein (i) the hydroprocessed product has a viscosity less than that of the hydrocarbon mixture and (ii) the hydroprocessing has a coke yield ≤0.1 wt. % based on the weight of the feed mixture.

Optionally, certain embodiments of the invention, such as one or more of the preceding embodiments, include one or more of the following features: (i) the second mixture comprises ≥0.5 wt. % of Tar Heavies based on the weight of the second mixture; (ii) the second mixture's Tar Heavies comprise ≥10.0 wt. % of Tar Heavies aggregates having an average size in the range of 10.0 nm to 300.0 nm in at least one dimension and an average number of carbon atoms ≥50, the weight percent being based on the weight of Tar Heavies in the second mixture; (iii) the aggregates comprise ≥90.0 wt. % of Tar Heavies molecules having a C:H atomic ratio in the range of from 1.0 to 1.8, a molecular weight in the range of 250 to 2500, and a melting point in the range of 100° C. to 700° C.; and wherein the third mixture comprises ≥50.0 wt. % of the second mixture's Tar Heavies aggregates based on the weight of the second mixture's Tar Heavies aggregates; and (iv) the third mixture comprises ≥90.0 wt. % of the second mixture's Tar Heavies aggregates based on the weight of the second mixture's Tar Heavies aggregates.

BRIEF DESCRIPTION OF THE FIGURE

FIG. 1 schematically illustrates an embodiment of the invention where a separation stage is utilized downstream of a hydroprocessing stage to separate and recycle a portion of the hydroprocessed product for use as the utility fluid.

DETAILED DESCRIPTION

The invention is based in part on the discovery that catalyst coking can be lessened by hydroprocessing the SCT in the presence of a utility fluid comprising a significant amount of aromatics, e.g., single or two ring aromatics. Unlike conventional SCT hydroprocessing, the process can be operated at temperatures and pressures that favor the desired hydrocracking reaction over aromatics hydrogenation. The term "SCT" means (a) a mixture of hydrocarbons having one or more aromatic core and optionally (b) non-aromatic and/or non-hydrocarbon molecules, the mixture being derived from hydrocarbon pyrolysis and having a boiling range ≥ about 550° F. (290° C.), e.g., ≥90.0 wt. % of the SCT molecules have an atmospheric boiling point ≥550° F. (290° C.). SCT can comprise, e.g., ≥50.0 wt. %, e.g., ≥75.0 wt. %, such as ≥90.0 wt. %, based on the weight of the SCT, of hydrocarbon molecules (including mixtures and aggregates thereof) having (i) one or more aromatic cores and (ii) a molecular weight ≥ about $C_{15}$.

It has been observed that SCT comprises a significant amount of Tar Heavies ("TH"). For the purpose of this description and appended claims, the term "Tar Heavies" means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane:SCT at 25.0° C. ("conventional pentane extraction"). The TH can include high-molecular weight molecules (e.g., MW≥600) such as asphaltenes and other high-molecular weight hydrocarbon. The term "asphaltene" means heptane insolubles as measured by ASTM D3279. For example, the TH can comprise ≥10.0 wt. % of high molecular-weight molecules having aromatic cores that are linked together by one or more of (i) relatively low molecular-weight alkanes and/or alkenes, e.g., $C_1$ to $C_3$ alkanes and/or alkenes, (ii) $C_5$ and/or $C_6$ cycloparaffinic rings, or (iii) thiophenic rings. Generally, ≥60.0 wt. % of the TH's carbon atoms are included in one or more aromatic cores based on the weight of the TH's carbon atoms, e.g., in the range of 68.0 wt. % to 78.0 wt. %. While not wishing to be bound by any theory or model, it is also believed that the TH form aggregates having a relatively planar morphology, as a result of Van der Waals attraction between the TH molecules. The large size of the TH aggregates, which can be in the range of, e.g., ten nanometers to several hundred nanometers ("nm") in their largest dimension, leads to low aggregate mobility and diffusivity under catalytic hydroprocessing conditions. In other words, conventional TH conversion suffers from severe mass-transport limitations, which result in a high selectivity for TH conversion to coke. It has been found that combining SCT with the utility fluid breaks down the aggregates into individual molecules of, e.g., ≤5.0 nm in their largest dimension and a molecular weight in the range of about 200 grams per mole to 2500 grams per mole. This results in greater mobility and diffusivity of the SCT's TH, leading to shorter catalyst-contact time and less conversion to coke under hydroprocessing condition. As a result, SCT conversion can be run at lower pressures, e.g., 500 psig to 1500 psig (34 bar (gauge)-100 bar (gauge)), leading to a significant reduction in cost and complexity over higher-pressure hydroprocessing. The invention is also advantageous in that the SCT is not over-cracked, so that the amount of light hydrocarbon produced during the hydroprocessing (e.g., hydrocarbon having 4 carbon atoms or fewer) is ≤5.0 wt. % based on the weight of the SCT. This further reduces the amount of hydrogen consumed in the hydroprocessing step.

SCT differs from other relatively high-molecular weight hydrocarbon mixtures, such as crude oil residue ("resid"), e.g., atmospheric resid or vacuum reside and other streams commonly encountered, e.g., in petroleum and petrochemical processing. For example, an SCT's aromatic carbon content is substantially greater than that of a resid. SCT generally has an aromatic carbon content ≥70.0 wt. % based on the weight of the SCT, whereas resid generally has an aromatic carbon content of ≤40.0 wt. % based on the weight of the resid. To clarify some of the differences between resid and SCT, selected properties of two representative SCT samples and three representative resid samples are set out in the following Table 1. Another important difference is that a significant fraction of the tar's asphaltenes have an atmospheric boiling point <565° C. For example, only 32.5 wt. % of asphaltenes in SCT 1 have an atmospheric boiling point ≥565° C. That is not the case for resid, where approximately 100% of a vacuum resid's asphaltenes have an atmospheric boiling point ≥565° C. Even though solvent extraction is an imperfect process, the results indicate that asphaltenes in a resid, such as a vacuum resid, are mostly heavy molecules having an atmospheric boiling point ≥1050° F. (565° C.). When subjected to heptane solvent extraction under substantially the same conditions as those used for vacuum resid, the asphaltenes contained in SCT contains a much greater percentage (on a wt. basis) of molecules having an atmospheric boiling point <565° C. than is the case for vacuum resid. SCT also differs from resid in the relative amount of metals and nitrogen-containing compounds present. In SCT, the total amount of metals is ≤1000.0 ppmw (parts per million, weight) based on the weight of the SCT, e.g., ≤100.0 ppmw, such as ≤10.0 ppmw, an amount that is much smaller than in crude oil vacuum resids, such as those resids containing ≥10.0 wt. % asphaltene in the resid's fraction having an atmospheric boiling point ≥565° C. (based on the total weight of the resid's fraction having an atmospheric boiling point that is ≥565° C.). The total amount of nitrogen present in SCT is ≤1000.0 ppmw based on the weight of the SCT, e.g., ≤100.0 ppmw, such as ≤10.0 ppmw, an amount that is generally much smaller than for such a crude oil vacuum resid.

TABLE 1

| | SCT 1 | SCT 2 | RESID 1 | RESID 2 | RESID 3 |
|---|---|---|---|---|---|
| CARBON (wt. %) | 89.9 | 91.3 | 86.1 | 83.33 | 82.8 |
| HYDROGEN (wt. %) | 7.16 | 6.78 | 10.7 | 9.95 | 9.94 |
| NITROGEN (wt. %) | 0.16 | 0.24 | 0.48 | 0.42 | 0.4 |
| OXYGEN (wt. %) | 0.69 | N.M. | 0.53 | 0.87 | |
| SULFUR (wt. %) | 2.18 | 0.38 | 2.15 | 5.84 | 6.1 |
| Kinematic Viscosity at 50° (cSt) | 988 | 7992 | >1,000 | >1,000 | >1,000 |
| Weight % having an atmospheric boiling point ≥ 565° C. | 16.5 | 20.2 | | | |
| Asphaltenes | 22.6 | 31.9 | 91 | 85.5 | 80 |
| NICKEL | N.M.* | N.M. | 52.5 | 48.5 | 60.1 |
| VANADIUM | N.M. | N.M. | 80.9 | 168 | 149 |
| IRON | N.M. | N.M. | 54.4 | 11 | 4 |
| Aromatic Carbon (wt. %) | 71.9 | 75.6 | 27.78 | 32.32 | 32.65 |
| Aliphatic Carbon (wt. %) | 28.1 | 24.4 | 72.22 | 67.68 | 67.35 |
| Methyls (wt. %) | 11 | 7.5 | 9.77 | 13.35 | 11.73 |
| % C in long chains (wt. %) | 0.7 | 0.63 | 11.3 | 15.28 | 10.17 |
| Aromatic H (wt. %) | 38.1 | 43.5 | N.M. | N.M. | 6.81 |
| % Sat H (wt. %) | 60.8 | 55.1 | N.M. | N.M. | 93.19 |
| Olefins (wt. %) | 1.1 | 1.4 | N.M. | N.M. | 0 |

*N.M. = Not Measured

Although the SCT's carbon and oxygen content (wt. basis) is similar to that of resid, the SCT's metals, hydrogen, nitrogen, and sulfur content (wt. basis) range is considerably lower. The SCT's kinematic viscosity (cSt) at 50° C. is generally ≥1000, even though the relative amount of SCT having an atmospheric boiling point ≥565° C. is much less than is the case for resid.

SCT is generally obtained as a product of hydrocarbon pyrolysis. The pyrolysis process can include, e.g., thermal pyrolysis, such as thermal pyrolysis processes utilizing water. One such pyrolysis process, steam cracking, is described in more detail below. The invention is not limited to steam cracking, and this description is not meant to foreclose the use of other pyrolysis processes within the broader scope of the invention.

Obtaining SCT by Pyrolysis

Conventional steam cracking utilizes a pyrolysis furnace which has two main sections: a convection section and a radiant section. The feedstock (first mixture) typically enters the convection section of the furnace where the first mixture's hydrocarbon component is heated and vaporized by indirect contact with hot flue gas from the radiant section and by direct contact with the first mixture's steam component. The steam-vaporized hydrocarbon mixture is then introduced into the radiant section where the cracking takes place. A second mixture is conducted away from the pyrolysis furnace, the second mixture comprising products resulting from the pyrolysis of the first mixture and any unreacted components of the first mixture. At least one separation stage is generally located downstream of the pyrolysis furnace, the separation stage being utilized for separating from the second mixture one or more of light olefin, SCN, SCGO, SCT, water, unreacted hydrocarbon components of the first mixture, etc. The separation stage can comprise, e.g., a primary fractionator. Optionally, a cooling stage is located between the pyrolysis furnace and the separation stage.

In one or more embodiments, SCT is obtained as a product of pyrolysis conducted in one or more pyrolysis furnaces, e.g., one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules and mixtures thereof. The liquid-phase products are generally conducted together to a separation stage, e.g., a primary fractionator, for separations of one or more of (a) overheads comprising steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 400° F. to 550° F. (200° C. to 290° C.), and (b) bottoms comprising ≥90.0 wt. % SCT, based on the weight of the bottoms, the SCT having a boiling range ≥ about 550° F. (290° C.) and comprising molecules and mixtures thereof having a molecular weight ≥ about $C_{15}$.

The feed to the pyrolysis furnace is a first mixture, the first mixture comprising ≥10.0 wt. % hydrocarbon based on the weight of the first mixture, e.g., ≥15.0 wt. %, such as ≥25.0 wt. %. Although the hydrocarbon can comprise, e.g., one or more of light hydrocarbons such as methane, ethane, propane, etc., it can be particularly advantageous to utilize the invention in connection with a first mixture comprising a significant amount of higher molecular weight hydrocarbons because the pyrolysis of these molecules generally results in more SCT than does the pyrolysis of lower molecular weight hydrocarbons. As an example, it can be advantageous for the first mixture to comprise ≥1.0 wt. % based on the weight of the first mixture of hydrocarbons that are in the liquid phase at atmospheric pressure.

The first mixture can further comprise diluent, e.g., one or more of nitrogen, water, etc., e.g., ≥1.0 wt. % diluent based on the weight of the first mixture, such as ≥25.0 wt. %. When the pyrolysis is steam cracking, the first mixture can be produced by combining the hydrocarbon with a diluent comprising steam, e.g., at a ratio of 0.2 to 4.0 kg steam per kg hydrocarbon.

In one or more embodiments, the first mixture's hydrocarbon comprises ≥10.0 wt. %, e.g., ≥50.0 wt. %, such as ≥90.0 wt. % (based on the weight of the hydrocarbon) of one or more of naphtha, gas oil, vacuum gas oil, crude oil, resid, or resid admixtures; including those comprising ≥ about 0.1 wt. % asphaltenes. Suitable crude oils include, e.g., high-sulfur virgin crude oils, such as those rich in polycyclic aromatics. Optionally, the first mixture's hydrocarbon component comprises sulfur, e.g., ≥0.1 wt. % sulfur based on the weight of the first mixture's hydrocarbon component, e.g., ≥1.0 wt. %, such as in the range of about 1.0 wt. % to about 5.0 wt. %. Optionally, at least a portion of the first mixture's sulfur-containing molecules, e.g., ≥10.0 wt. % of the first mixture's sulfur-containing molecules, contain at least one aromatic ring ("aromatic sulfur"). When (i) the first mixture's hydrocarbon is a crude oil or crude oil fraction comprising ≥0.1 wt. % of aromatic sulfur and (ii) the pyrolysis is steam cracking, then the, SCT contains a significant amount of sulfur derived from the first mixture's aromatic sulfur. For example, the SCT sulfur content can be about 3 to 4 times higher in the SCT than in the first mixture's hydrocarbon component, on a weight basis.

In a particular embodiment, the first mixture's hydrocarbon comprises one or more crude oils and/or one or more crude oil fractions, such as those obtained from an atmospheric pipestill ("APS") and/or vacuum pipestill ("VPS"). The crude oil and/or fraction thereof is optionally desalted prior to being included in the first mixture. An example of a crude oil fraction utilized in the first mixture is produced by combining separating APS bottoms from a crude oil and followed by VPS treatment of the APS bottoms.

Optionally, the pyrolysis furnace has at least one vapor/liquid separation device (sometimes referred to as flash pot or flash drum) integrated therewith, for upgrading the first mixture. Such vapor/liquid separator devices are particularly suitable when the first mixture's hydrocarbon component comprises ≥ about 0.1 wt. % asphaltenes based on the weight of the first mixture's hydrocarbon component, e.g., ≥ about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; and 7,235,705, which are incorporated by reference herein in their entirety. Suitable vapor/liquid separation devices are also disclosed in U.S. Pat. Nos. 6,632,351 and 7,578,929, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

In embodiments using a vapor/liquid separation device integrated with the pyrolysis furnace, at least a portion of the first mixture's hydrocarbon component is provided to the inlet of a convection section of a pyrolysis unit, wherein hydrocarbon is heated so that at least a portion of the hydrocarbon is in the vapor phase. When a diluent (e.g., steam) is utilized, the first mixture's diluent component is optionally (but preferably) added in this section and mixed with the hydrocarbon component to produce the first mixture. The first mixture, at least a portion of which is in the vapor phase, is then flashed in at least one vapor/liquid separation device in order to separate and conduct away from the first mixture at least a portion of the first mixture's high molecular-weight molecules, such as asphaltenes. A bottoms fraction can be conducted away from the vapor-liquid separation device, the bottoms fraction comprising, e.g., ≥10.0% (on a wt. basis) of the first mixture's asphaltenes. When the pyrolysis is steam cracking and the first mixture's hydrocarbon component comprises one or more crude oil or fractions thereof, the steam cracking furnace can be integrated with a vapor/liquid separation device operating at a temperature in the range of from about 600° F. to about 950° F. and a pressure in the range of about 275 kPa to about 1400 kPa, e.g., a temperature in the range of from about 430° C. to about 480° C. and a pressure in the range of about 700 kPa to 760 kPa. The overheads from the vapor/liquid separation device can be subjected to further heating in the convection section, and are then introduced via crossover piping into the radiant section where the overheads are exposed to a temperature ≥760° C. at a pressure ≥0.5 bar (g) e.g., a temperature in the range of about 790° C. to about 850° C. and a pressure in the range of about 0.6 bar (g) to about 2.0 bar (g), to carry out the pyrolysis (e.g., cracking and/or reforming) of the first mixture's hydrocarbon component.

One of the advantages of having a vapor/liquid separation device downstream of the convection section inlet and upstream of the crossover piping to the radiant section is that it increases the range of hydrocarbon types available to be used directly, without pretreatment, as hydrocarbon components in the first mixture. For example, the first mixture's hydrocarbon component can comprise ≥50.0 wt. %, e.g., ≥75.0 wt. %, such as ≥90.0 wt. % (based on the weight of the first mixture's hydrocarbon component) of one or more crude oils, even high naphthenic acid-containing crude oils and fractions thereof. Feeds having a high naphthenic acid content are among those that produce a high quantity of tar and are especially suitable when at least one vapor/liquid separation device is integrated with the pyrolysis furnace. If desired, the first mixture's composition can vary over time, e.g., by utilizing a first mixture having a first hydrocarbon component during a first time period and then utilizing a first mixture having a second hydrocarbon component during a second time period, the first and second hydrocarbons being substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This embodiment can be utilized for the sequential pyrolysis of incompatible first and second hydrocarbon components (i.e., where the first and second hydrocarbon components are mixtures that are not sufficiently compatible to be blended under ambient conditions). For example, a first hydrocarbon component comprising a virgin crude oil can be utilized to produce the first mixture during a first time period and steam cracked tar utilized to produce the first mixture during a second time period.

In other embodiments, the vapor/liquid separation device is not used. For example when the first mixture's hydrocarbon comprises crude oil and/or one or more fractions thereof, the pyrolysis conditions can be conventional steam cracking conditions. Suitable steam cracking conditions include, e.g., exposing the first mixture to a temperature (measured at the radiant outlet) ≥400° C., e.g., in the range of 400° C. to 900° C., and a pressure ≥0.1 bar, for a cracking residence time period in the range of from about 0.01 second to 5.0 second. In one or more embodiments, the first mixture comprises hydrocarbon and diluent, wherein the first mixture's hydrocarbon comprises ≥50.0 wt. % based on the weight of the first mixture's hydrocarbon of one or more of waxy residues, atmospheric residues, naphtha, residue admixtures, or crude oil. The diluent comprises, e.g., ≥95.0 wt. % water based on the weight of the diluent. When the first mixture comprises 10.0 wt. % to 90.0 wt. % diluent based on the weight of the first mixture, the pyrolysis conditions generally include one or more of (i) a temperature in the range of 760° C. to 880° C.; (ii) a pressure in the range of from 1.0 to 5.0 bar (absolute); or (iii) a residence time in the range of from 0.10 to 2.0 seconds.

A second mixture is conducted away from the pyrolysis furnace, the second mixture being derived from the first mixture by the pyrolysis. When the specified pyrolysis conditions are utilized, the second mixture generally comprises ≥1.0 wt. % of $C_2$ unsaturates and ≥0.1 wt. % of TH, the weight percents being based on the weight of the second mixture. Optionally, the second mixture comprises ≥5.0 wt. % of $C_2$ unsaturates and/or ≥0.5 wt. % of TH, such as ≥1.0 wt. % TH. Although the second mixture generally contains a mixture of the desired light olefins, SCN, SCGO, SCT, and unreacted components of the first mixture (e.g., water in the case of steam cracking, but also in some cases unreacted hydrocarbon), the relative amount of each of these generally depends on, e.g., the first mixture's composition, pyrolysis furnace configuration, process conditions during the pyrolysis, etc. The second mixture is generally conducted away for the pyrolysis section, e.g., for cooling and/or separation stages.

In one or more embodiments, the second mixture's TH comprise ≥10.0 wt. % of TH aggregates having an average size in the range of 10.0 nm to 300.0 nm in at least one dimension and an average number of carbon atoms ≥50, the weight percent being based on the weight of Tar Heavies in the second mixture. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Although it is not required, the invention is compatible with cooling the second mixture downstream of the pyrolysis furnace, e.g., the second mixture can be cooled using a system comprising transfer line heat exchangers. For example, the transfer line heat exchangers can cool the process stream to a temperature in the range of about 1000° F. (540° C.) to about 1100° F. (600° C.), in order to efficiently generate super-high pressure steam which can be utilized by the process or conducted away. If desired, the second mixture can be subjected to direct quench at a point typically between the furnace outlet and the separation stage. The quench can be accomplished by contacting the second mixture with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench liquids include liquid quench oil, such as those obtained by a downstream quench oil knock-out drum, pyrolysis fuel oil and water, which can be obtained from conventional sources, e.g., condensed dilution steam.

A separation stage is generally utilized downstream of the pyrolysis furnace for separating from the second mixture one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. In the separation stage, a third mixture can be separated from the second mixture, with the third mixture comprising ≥10.0 wt. % of the second mixture's TH based on the weight of the second mixture's TH. When the pyrolysis is steam cracking, the third mixture generally comprises SCT, which is obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the third mixture can comprise ≥50.0 wt. % SCT based on the weight of the third mixture, such as ≥75.0 wt. %, or ≥90.0 wt. %, or ≥99.0 wt. %.

In one or more embodiments, the third mixture comprises ≥50.0 wt. % of the second mixture's TH based on the weight of the second mixture's TH. For example, the third mixture can comprise ≥90.0 wt. % of the second mixture's TH based on the weight of the second mixture's TH. The third mixture can have, e.g., (i) a sulfur content in the range of 0.5 wt. to 7.0 wt. %, (ii) a TH content in the range of from 5.0 wt. % to 40.0 wt. %, the weight percents being based on the weight of the third mixture, (iii) a density at 15.0° C. in the range of 1.01 g/cm$^3$ to 1.15 g/cm$^3$, e.g., in the range of 1.07 g/cm$^3$ to 1.15 g/cm$^3$, and (iv) a 50° C. viscosity in the range of 200 cSt to $1.0\times10^7$ cSt.

The third mixture can comprise TH aggregates. In one or more embodiments, the third mixture comprises ≥50.0 wt. % of the second mixture's TH aggregates based on the weight of the second mixture's TH aggregates. For example, the third mixture can comprise ≥90.0 wt. % of the second mixture's TH aggregates based on the weight of the second mixture's TH aggregates.

The third mixture is generally conducted away from the separation stage for hydroprocessing of the third mixture in the presence of a utility fluid. Examples of utility fluids useful in the invention will now be described in more detail. The invention is not limited to the use of these utility fluids, and this description is not meant to foreclose other utility fluids within the broader scope of the invention.

Utility Fluid

The utility fluid is utilized in hydroprocessing the third mixture (e.g., an SCT stream). It has been observed that hydroprocessing the specified third mixture in the presence of the specified utility fluid leads to an increased run-length during hydroprocessing and improved properties of the hydroprocessed product. Generally, the utility fluid comprises aromatics, i.e., comprises molecules having at least one aromatic core. In certain embodiments, the utility fluid comprises ≥40.0 wt. % aromatic carbon based on the weight of the utility fluid, such as ≥60.0 wt. %. The amount of aromatic carbon can be determined by Nuclear Magnetic Resonance, (e.g., $^{13}$C NMR). The utility fluid can have an ASTM D86 10% distillation point ≥60° C. and a 90% distillation point ≤350° C. Optionally, the utility fluid (which can be a solvent or mixture of solvents) has an ASTM D86 10% distillation point ≥120° C., e.g., ≥140° C., such as ≥150° C. and/or an ASTM D86 90% distillation point ≤300° C.

In one or more embodiments, the utility fluid (i) has a critical temperature in the range of 285° C. to 400° C., and (ii) comprises ≥80.0 wt. % of 1-ring aromatics and/or 2-ring aromatics, including alkyl-functionalized derivatives thereof, based on the weight of the utility fluid. For example, the utility fluid can comprise, e.g., ≥90.0 wt. % of a single-ring aromatic, including those having one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the utility fluid comprises ≥90.0 wt. % based on the weight of the utility fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins). It is generally desirable for the utility fluid to be substantially free of molecules having alkenyl functionality, particularly in embodiments utilizing a hydroprocessing catalyst having a tendency for coke formation in the presence of such molecules. In an embodiment, the utility fluid comprises ≤10.0 wt. % of $C_1$-$C_6$ sidechains having alkenyl functionality, based on the weight of the utility fluid.

In certain embodiments, the utility fluid comprises SCN and/or SCGO, e.g., SCN and/or SCGO separated from the second mixture in a primary fractionator downstream of a pyrolysis furnace operating under steam cracking conditions. The utility fluid can comprise, e.g., ≥50.0 wt. % of the separated gas oil, based on the weight of the utility fluid. In certain embodiments, at least a portion of the utility fluid is obtained from the hydroprocessed product, e.g., by separating and re-cycling a portion of the hydroprocessed product having an atmospheric boiling point ≤300° C. Optionally, the utility fluid comprises hydroprocessed SCN and/or SCGO, e.g., ≥50.0 wt. % of a hydroprocessed SCN and/or SCGO based on the weight of the utility fluid.

Generally, the utility fluid contains sufficient amount of molecules having one or more aromatic cores to effectively increase run length during hydroprocessing of the third mixture. For example, the utility fluid can comprise ≥50.0 wt. % of molecules having at least one aromatic core, e.g., ≥60.0 wt. %, such as ≥70 wt. %, based on the total weight of the utility fluid. In an embodiment, the utility fluid comprises (i) ≥60.0 wt. % of molecules having at least one aromatic core and (ii) ≤1.0 wt. % of $C_1$-$C_6$ sidechains having alkenyl functionality, the weight percents being based on the weight of the utility fluid.

The relative amounts of utility fluid and third mixture during hydroprocessing are generally in the range of from about 20.0 wt. % to about 95.0 wt. % of the third mixture and from about 5.0 wt. % to about 80.0 wt. % of the utility fluid, based on total weight of utility fluid plus third mixture. For example, the relative amounts of utility fluid and third mixture during hydroprocessing can be in the range of (i) about 20.0 wt. % to about 90.0 wt. % of the third mixture and about 10.0 wt. % to about 80.0 wt. % of the utility fluid, or (ii) from about 40.0 wt. % to about 90.0 wt. % of the third mixture and from about 10.0 wt. % to about 60.0 wt. % of the utility fluid. At least a portion of the utility fluid can be combined with at least a portion of the third mixture within the hydroprocessing vessel or hydroprocessing zone, but this is not required, and in one or more embodiments at least a portion of the utility fluid and at least a portion of the third mixture are supplied as separate streams and combined into one feed stream prior to entering (e.g., upstream of) the hydroprocessing vessel or hydroprocessing zone.

Hydroprocessing

Hydroprocessing of the third mixture in the presence of the utility fluid can occur in one or more hydroprocessing stages, the stages comprising one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the third mixture in the presence of the utility fluid, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt. % of one or more metals selected from Groups 6, 8, 9, and 10 of the Periodic Table and (ii) ≥1.0 wt. % of an inorganic oxide, the weight percents being based on the weight of the catalyst.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Hydroprocessing the specified amounts of third mixture and utility fluid using the specified hydroprocessing catalyst leads to improved catalyst life, e.g., allowing the hydroprocessing stage to operate for at least 3 months, or at least 6 months, or at least 1 year without replacement of the catalyst in the hydroprocessing or contacting zone. Catalyst life is generally >10 times longer than would be the case if no utility fluid were utilized, e.g., ≥100 times longer, such as ≥1000 times longer.

The hydroprocessing is carried out in the presence of hydrogen, e.g., by (i) combining molecular hydrogen with the third mixture and/or utility fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥ about 50 vol. % of molecular hydrogen, e.g., ≥ about 75 vol. %, based on the total volume of treat gas conducted to the hydroprocessing stage.

Optionally, the amount of molecular hydrogen supplied to the hydroprocessing stage is in the range of from about 300 SCF/B (standard cubic feet per barrel) (53 S $m^3/m^3$) to 5000 SCF/B (890 S $m^3/m^3$), in which B refers to barrel of the third mixture. For example, the molecular hydrogen can be provided in a range of from 1000 SCF/B (178 S $m^3/m^3$) to 3000 SCF/B (534 S $m^3/m^3$). Hydroprocessing the third mixture in the presence of the specified utility fluid, molecular hydrogen, and a catalytically effective amount of the specified hydroprocessing catalyst under catalytic hydroprocessing conditions produces a hydroprocessed product including, e.g., upgraded SCT. An example of suitable catalytic hydroprocessing conditions will now be described in more detail. The invention is not limited to these conditions, and this description is not meant to foreclose other hydroprocessing conditions within the broader scope of the invention.

The hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified third mixture. The hydroprocessing reaction can be carried out in at least one vessel or zone that is located, e.g., within a hydroprocessing stage downstream of the pyrolysis stage and separation stage. The specified third mixture generally contacts the hydroprocessing catalyst in the vessel or zone, in the presence of the utility fluid and molecular hydrogen. Catalytic hydroprocessing conditions can include, e.g., exposing the combined diluent-third mixture to a temperature in the range from 50° C. to 500° C. or from 60° C. to 440° C. or from 70° C. to 430° C. or from 80° C. to 420° C. proximate to the molecular hydrogen and hydroprocessing catalyst. For example, a temperature in the range of from 300° C. to 500° C., or 350° C. to 420° C., or 360° C. to 400° C. can be utilized. Liquid hourly space velocity (LHSV) of the combined diluent-third mixture will generally range from 0.1 $h^{-1}$ to 30 $h^{-1}$, or 0.4 $h^{-1}$ to 25 $h^{-1}$, or 0.5 $h^{-1}$ to 20 $h^{-1}$. In some embodiments, LHSV is at least 5 $h^{-1}$, or at least 10 $h^{-1}$, or at least 15 $h^{-1}$. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In some embodiments, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, e.g., 20 bar to 120 bar or 20 bar-100 bar, a space velocity in the range of 0.1 to 5.0, and a molecular hydrogen consumption rate of about 50 standard cubic meters/cubic meter (S $m^3/m^3$) to about 450 S $m^3/m^3$ (300 SCF/B to 2500 SCF/B), based on a barrel of third mixture. In one or more embodiment, the hydroprocessing conditions include one or more of a temperature in the range of 380° C. to 430° C., a pressure in the range of 21 bar (absolute) to 81 bar (absolute), a space velocity (LHSV) in the range of 0.2 to 1.0, and a hydrogen consumption rate of about 70 S $m^3/m^3$ to about 270 S $m^3/m^3$ (400 SCF/B to 1500 SCF/B) based on the volume of tar. When operated under these conditions using the specified catalyst, TH hydroconversion conversion is generally ≥25.0% on a weight basis, e.g., ≥50.0%.

An embodiment of the invention is shown schematically in FIG. 1. A feedstock comprising (i) tar, such as SCT, provided via conduit 1 and (ii) utility fluid provided by conduit 9 are combined to produce a first mixture, the first mixture being conducted via conduit 8 to hydroprocessing reactor 2 for hydroprocessing under one or more of the specified hydroprocessing conditions. The utility fluid can be obtained from an external source via conduit 10, from a suitable source downstream of reactor 2, or a combination thereof. Treat gas (comprising molecular hydrogen) is conducted to reactor 2 by one or more conduits (not shown). The reactor effluent generally comprises (i) a vapor-phase mixture and (ii) a hydroprocessed product which is generally in the liquid phase. The vapor phase mixture can comprise, e.g., hydrogen sulfide, molecular hydrogen, methane, and other light gasses having a molecular weight ≤16. The hydroprocessed product comprises hydroprocessed tar and generally further comprises certain compounds derived from the utility fluid during the hydroprocessing and any unreacted utility fluid. The reactor's effluent is conducted via conduit 3 to separation stage 4.

Stage 4 can be utilized for separating from the reactor effluent (i) the vapor-phase mixture and (ii) the hydroprocessed product. Optionally, a portion of the hydroprocessed product can be separated and conducted away from separation stage 4 via conduit 7 for use in producing the utility fluid. For example, at least a portion of (i) any unconverted utility fluid and (ii) compounds having an atmospheric boiling point in approximately the same range as the utility fluid can be separated from the hydroprocessed product and recycled via conduit 7 for use in producing the utility fluid. An offgas comprising at least a portion of the vapor-phase mixture conducted to separation stage 4 via conduit 3 can be separated and conducted away from the process via conduit 6. The hydroprocessed product can be conducted away from stage 4 via conduit 5. Stage 4 can utilize conventional separations means, e.g., one or more flash drums, splitters, fractionation towers, membranes, absorbents, etc., though the invention is not limited thereto.

Hydroprocessed Product

In one or more embodiments, the invention also includes conducting a hydroprocessed product (e.g., the liquid-phase portion of the hydroprocessor effluent) away from the hydroprocessing stage, and then separating from the hydroprocessed product a fourth mixture, the fourth mixture comprising ≥90.0 wt. % of molecules having an atmospheric boiling point ≤300° C. based on the weight of the fourth mixture. The remainder of the hydroprocessed product following separation of the fourth mixture generally comprises a fifth mixture, the fifth mixture having a sulfur content that is ≤0.5 times (wt. basis) that of the third mixture and a TH content ≤0.7 times the TH content of the third mixture. Generally, the fifth mixture comprises ≥20.0 wt. % of the hydroprocessed product, e.g., ≥40.0 wt. %, based on the weight of the hydroprocessed product, such as in the range of 20.0 wt. % to 70.0 wt. % or in the range of 40.0 wt. % to 60.0 wt. %. When the hydroprocessing is operated under the conditions specified in the preceding section utilizing as a feed the specified third mixture, fifth mixture generally has a density ≥1.00 g/$cm^3$ and a viscosity ≤90.0% that of the third mixture's viscosity, e.g., ≤75.0% that of the third mixture's viscosity. Generally, ≥50.0 wt. % the fifth mixture is in the form of multi-nuclear aromatic molecules having a number of carbon atoms ≥16 based on the weight of the fifth mixture, e.g., ≥75.0 wt. %, such as ≥90.0 wt. %. Optionally, ≥50.0 wt. % the fifth mixture is in the form of multi-nuclear aromatic molecules. These can have, e.g., a number of carbon atoms in the range of from 25 to 40 based on the weight of the fifth mixture.

If desired, at least a portion of the fourth mixture and/or at least a portion of the fifth mixture can be utilized within the process and/or conducted away for storage or further processing. For example, the relatively low viscosity of the fifth mixture compared to that of the third mixture can make it desirable to utilize at least a portion of the fifth mixture as a diluent (e.g., flux) for conducting away a high-viscosity bottoms from a vapor-liquid separation device, such as those integrated with a pyrolysis furnace. In one or more embodiments, ≥10.0% of the fifth mixture (on a wt. basis) e.g., ≥50.0%, such as ≥75.0%, can be combined with ≥10.0% (on a wt. basis) of the bottoms fraction, e.g., ≥50.0%, such as ≥75.0%, in order to lessen the bottom's viscosity. In certain embodiments, at least a portion of the fourth mixture is recycled upstream of the hydroprocessing stage for use as the utility fluid. For example, ≥10.0 wt. % of the fourth mixture can be utilized as the utility fluid, such as ≥90.0 wt. %, based on the weight of the fourth mixture. When the amount of fourth mixture is not sufficient to produce the desired amount of utility fluid, a make-up portion of utility fluid can be provided to the process from another source.

In one or more embodiments, low and high boiling-range cuts are separated from at least a portion of the fifth mixture, e.g., at a cut point in the range of about 320° C. to about 370° C., such as about 334° C. to about 340° C. With a cut point in this range, ≥40.0 wt. % of the fifth mixture is generally contained in the lower-boiling fraction, e.g., ≥50.0 wt. %, based on the weight of the fifth mixture. At least a portion of the lower-boiling fraction can be utilized as a flux, e.g., for fluxing vapor/liquid separator bottoms, primary fractionator bottoms, etc. At least a portion of the higher-boiling fraction can be utilized as a fuel, for example.

Alternatively, or in addition, the process can further comprise hydrogenating at least a portion of the hydroprocessed product, e.g., at least a portion of the fifth mixture, to produce naphthenic lubricating oil.

Example 1

SCT 1, having the properties set out in Table 1, is obtained from primary fractionator bottoms, the primary fractionator being located downstream of a pyrolysis furnace. The SCT is combined with a utility fluid comprising ≥98.0 wt. % of trimethylbenzene to produce a mixture comprising 60.0 wt. % of the SCT and 40.0 wt. % of the utility fluid based on the weight of the mixture.

A stainless steel fixed-bed reactor is utilized for hydroprocessing the SCT 1-utility fluid mixture, the reactor having an inside diameter of 7.62 mm and three heating blocks. The reactor is heated by a three-zone furnace. The reactor's central portion was loaded with 12.6 grams of conventional Co—Mo/$Al_2O_3$ residfining catalyst, RT-621, sized to 40-60 mesh. Reactor zones on either side of the central zone are loaded with 80-100 mesh silicon carbide. After loading, the reactor is pressure tested a 68 bar (absolute) using molecular nitrogen, followed by molecular hydrogen.

During catalyst sulfiding, 200 $cm^3$ of a sulfiding solution is gradually introduced into the reactor during the following time intervals. The sulfiding solution comprises 80 wt. % of a 130N lubricating oil basestock and 20 wt. % of ethyldisulfide based on the weight of the sulfiding solution. The sulfiding solution has a sulfur content of 0.324 moles of sulfur per 100 $cm^3$ of sulfiding solution. Initially, the sulfiding solution is introduced at a rate of 60 $cm^3$/hr at a pressure of 51 bar (absolute) and a temperature of 25° C. After about one hour the rate is reduced to 2.5 $cm^3$ per hour and molecular hydrogen is introduced at a rate of 20 standard $cm^3$ per minute while exposing the catalyst to a temperature of 25° C. After introducing the molecular hydrogen, the catalyst is exposed to an increasing temperature at a rate of 1° C. per minute, until a temperature of 110° C. is achieved, and then maintaining the 110° C. temperature for one hour. The catalyst is again exposed to an increasing temperature at a rate of 1° C. per minute until a temperature of 250° C. is achieved, and then maintaining the 250° C. temperature for 12 hours. The catalyst is yet again exposed to an increasing temperature at a rate of 1° C. per minute until a temperature of 340° C. is achieved, and then maintaining the 340° C. temperature until all of the 200 $cm^3$ of sulfiding solution is consumed, i.e., sulfiding solution consumption being measured from the start of sulfiding.

After sulfiding, the SCT 1-utility fluid mixture is introduced at a rate of 6.0 $cm^3$/hr (0.34 LHSV). The reactor temperature is increased at a rate of 1° C. per minute until a temperature in the range of 375° C. to 425° C. is achieved. The mixture and sulfided catalyst are exposed to a temperature in the range of 375° C. to 425° C., a pressure in the range of 51 bar (absolute) to 82 bar (absolute), and a molecular hydrogen flow rate of 54 $cm^3$/min (3030 SCF/B).

The hydrotreating is carried out for 80 days, the conversion of the SCT's molecules having an atmospheric boiling point ≥565° C. is constant at about 60% (wt. basis) over the 80 day period, indicating no significant catalyst coking. The substantially constant molecular hydrogen consumption rate of 195 S $m^3/m^3$ based on the volume of SCT-1 (within about +/−10%) over the 80 day period is indicative of a relatively low-level of SCT hydrogenation. For comparison purpose, the amount of hydrogen consumption would have been much more than 195 S $m^3/m^3$ if significant aromatics hydrogenation occurs.

The total liquid product (TLP) conducted away from the hydrotreating is sampled at the eight and twentieth day of the eighty-day hydrotreating test. Rotary evaporation is utilized to remove from the TLP molecules having an atmospheric boiling point ≤300.0° C., such as the trimethylbenzene solvent. The remainder of the TLP after rotary evaporation separation (the upgraded SCT) is analyzed for sulfur content and viscosity for comparison with the SCT-1 feed.

Results of these analysis show that the upgraded SCT samples contain 0.06 wt. % sulfur (eighth day sample) and 0.3 wt. % sulfur (twentieth day sample), which amounts are much less than the 2.18 wt. % sulfur of the SCT-1 feed. The results also show a significant kinetic viscosity improvement of 5.8 cSt at 50° C. (eighth day sample) and 12.8 cSt at 50° C. (twentieth day sample) over the SCT-1 value of 988 cSt at 50° C.

Example 2

40.0 wt. % of second SCT sample (SCT 2, from Table 1) is combined with 60.0 wt. % of the utility fluid utilized in Example 1 to produce an SCT-utility fluid mixture. The mixture was hydrotreated in reactor that is substantially similar to the one utilized in Example 1, utilizing substantially the same catalyst as in Example 1. The catalyst is subjected to substantially the same sulfiding treatment as in Example 1, and the hydrotreating conditions are also substantially the same. The hydrotreating is conducted for >30 days without significant catalyst deactivation. This example demonstrates that SCT hydrotreating can be utilized even in the case of SCT having a kinematic viscosities ≥7000 cSt at 50° C.

Example 3

SCT 1 is distilled to produce a bottoms fraction comprising 50 wt. % of the SCT-1, based on the weight of the SCT-1. The bottoms fraction, which is a solid at room temperature, has a $T_{10}$ of approximately 430° C. and a $T_{45}$ of approximately 560° C. A mixture is produced by combining 60.0 wt. % of the bottoms fraction and 40.0 wt. % of the utility fluid utilized in Example 1, the weight percents being based on the weight of the mixture. The mixture is hydrotreated in the same reactor as utilized in Example 1, under substantially the same process conditions. The catalyst utilized is substantially the same as that of Example 1, and is sulfide in substantially the same way. The hydrotreating is conducted for 15 days without a significant change in the conversion of the mixture's 565° C., indicating good catalyst stability without significant catalyst coking.

This example demonstrates that reactor sizes and hydrogen consumption can be lessened without significant catalyst deactivation by treating only the fraction of SCT with the highest viscosity and lowest hydrogen content. In other words, the fraction of the tar that benefits the most from hydrotreating can be hydrotreated without significant catalyst coking. The example also demonstrates that one-ring aromatic streams (such as the utility fluid) can be blended with highly aromatic tars that are solids at room temperature and that such a blend can be hydrotreated without significant catalyst coking or reactor fouling. The remaining fraction(s) of SCT-1 from the initial separation of Example 3 are readily hydroprocessed using conventional means.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydrocarbon conversion process, comprising:

(a) providing a first mixture comprising ≥10.0 wt. % hydrocarbon based on the weight of the first mixture;

(b) exposing the first mixture to a temperature ≥400° C. under pyrolysis conditions to produce a second mixture comprising ≥1.0 wt. % of $C_2$ unsaturates, and ≥0.1 wt. % of Tar Heavies, the weight percents being based on the weight of the second mixture;

(c) separating from the second mixture a third mixture comprising ≥10.0 wt. % of the second mixture's Tar Heavies based on the weight of the second mixture's Tar Heavies;

(d) providing a utility fluid, the utility fluid comprising aromatics and having an ASTM D86 10% distillation point ≥60.0° C. and a 90% distillation point ≤350.0° C., wherein the utility fluid (i) has a critical temperature in the range of 285° C. to 400° C. and (ii) comprises ≥80.0 wt. % of 1-ring aromatics and/or 2-ring aromatics, including alkyl-functionalized derivatives thereof, based on the weight of the utility fluid; and (e) contacting the third mixture with at least one hydroprocessing catalyst under catalytic hydroprocessing conditions in the presence of molecular hydrogen and the utility fluid to convert at least a portion of the third mixture to a hydroprocessed product, wherein (i) the hydroprocessed product has a viscosity less than that of the third mixture and (ii) the hydroprocessing has a coke yield ≤0.1 wt. % based on the weight of the third mixture.

2. The method of claim 1, wherein the first mixture's hydrocarbon comprises ≥50.0 wt % based on the weight of the first mixture's hydrocarbon of one or more of waxy residues, atmospheric residues, naphtha, residue admixtures, or crude oil.

3. The method of claim 1, wherein the first mixture further comprises ≥25.0 wt. % diluent based on the weight of the first mixture.

4. The method of claim 3, wherein the diluent comprises ≥95.0 wt. % water based on the weight of the diluent, the first mixture comprises 10.0 wt. % to 90.0 wt. % diluent based on the weight of the first mixture, and the pyrolysis conditions include one or more of:

(i) a temperature in the range of 760° C. to 880° C.;

(ii) a pressure in the range of from 1.0 to 5.0 bar (absolute); and (iii) a residence time in the range of from 0.10 to 2.0 seconds.

5. The method of claim 1, wherein the second mixture comprises ≥0.5 wt. % of Tar Heavies based on the weight of the second mixture.

6. The method of claim 1, wherein the second mixture's Tar Heavies comprise ≥10.0 wt. % of Tar Heavies aggregates having an average size in the range of 10.0 nm to 300.0 nm in at least one dimension and an average number of carbon atoms ≥50, the weight percent being based on the weight of Tar Heavies in the second mixture.

7. The method of claim 6, wherein the aggregates comprise ≥90.0 wt. % of Tar Heavies molecules having a C:H atomic ratio in the range of from 1.0 to 1.8, a molecular weight in the range of 250 to 2500, and a melting point in the range of 100° C. to 700° C.; and wherein the third mixture comprises ≥50.0 wt. % of the second mixture's Tar Heavies aggregates based on the weight of the second mixture's Tar Heavies aggregates.

8. The method of claim 5, wherein the third mixture comprises ≥90.0 wt. % of the second mixture's Tar Heavies aggregates based on the weight of the second mixture's Tar Heavies aggregates, and wherein the third mixture has one or more of (i) a sulfur content in the range of 0.1 wt. % to 7.0 wt. %, (ii) a Tar Heavies content in the range of from 5.0 wt. % to 40.0 wt. %, the weight percents being based on the weight of the third mixture, (iii) a density in the range of 1.01 g/cm$^3$ to 1.15 g/cm$^3$, and (iv) a 50° C. viscosity in the range of 100 cSt to $1.0\times10^7$ cSt.

9. The method of claim 1, wherein the utility fluid comprises ≥90.0 wt. % based on the weight of the utility fluid of one or more of benzene, ethylbenzene, trimethylbenzene, xylene, toluene, or methylaphthalenes; and wherein the relative amounts of utility fluid and third mixture during the hydroprocessing are in the range of 40 wt. % to 90.0 wt. % of the third mixture and 10.0 wt. % to 60.0 wt. % of the utility fluid, the weight percents being based on the amount of utility fluid and third mixture present during the hydroprocessing.

10. The method of claim 1, wherein the hydroprocessing conditions include one or more of a temperature in the range of 300° C. to 500° C., a pressure in the range of 15 bar (absolute) to 135 bar, an LHSV in the range of 0.1 to 5.0, and a molecular hydrogen consumption rate of 50 S m$^3$/m$^3$ to 270 S m$^3$/m$^3$.

11. The method of claim 1, wherein the hydroprocessing conditions include one or more of a temperature in the range of 380° C. to 430° C., a pressure in the range of 21 bar to 81 bar, an LHSV in the range of 0.2 to 1.0, and a hydrogen consumption rate of 70 S m$^3$/m$^3$ to 270 S m$^3$/m$^3$.

12. The method of claim 1, wherein the hydroprocessing catalyst comprises (i) ≥1.0 wt. % of one or more metals selected from Groups 6, 8, 9, and 10 of the Periodic Table and (ii) ≥1.0 wt. % of an inorganic oxide, the weight percents being based on the weight of the hydroprocessing catalyst.

13. The method of claim 1, further comprising separating gas oil from the second mixture.

14. The method of claim 13, wherein (i) the gas oil comprises ≥90.0 wt. % SCGO based on the weight of the gas oil and (ii) the utility fluid comprises ≥50.0 wt. % of the separated gas oil, based on the weight of the utility fluid.

15. The method of claim 14, further comprising combining at least a portion of the third mixture and at least a portion of the utility fluid upstream of the hydroprocessing.

16. The method of claim 13, further comprising deriving from the separated gas oil ≥5.0 wt. % of the utility fluid based on the weight of the utility fluid.

17. A hydrocarbon conversion process, comprising:

(a) providing a first mixture comprising ≥10.0 wt. % hydrocarbon based on the weight of the first mixture;

(b) exposing the first mixture to a temperature ≥400° C. under pyrolysis conditions to produce a second mixture comprising ≥1.0 wt. % of $C_2$ unsaturates, and ≥0.1 wt. % of Tar Heavies, the weight percents being based on the weight of the second mixture;

(c) separating from the second mixture a third mixture comprising ≥10.0 wt. % of the second mixture's Tar Heavies based on the weight of the second mixture's Tar Heavies;

(d) providing a utility fluid, the utility fluid comprising aromatics and having an ASTM D86 10% distillation point ≥60.0° C. and a 90% distillation point ≤350.0° C.;

(e) contacting the third mixture with at least one hydroprocessing catalyst under catalytic hydroprocessing conditions in the presence of molecular hydrogen and the utility fluid to convert at least a portion of the third mixture to a hydroprocessed product, wherein (i) the hydroprocessed product has a viscosity less than that of the third mixture and (ii) the hydroprocessing has a coke yield ≤0.1 wt. % based on the weight of the third mixture;

(f) conducting away the hydroprocessed product from step (c); and (g) separating from the hydroprocessed product a fourth mixture, the fourth mixture comprising ≥90.0 wt. % of molecules having an atmospheric boiling point ≤300° C.; the remainder of the hydroprocessed product comprising a fifth mixture, the fifth mixture having a sulfur content that is ≤0.5 times (wt. basis) that of the third mixture, and a Tar Heavies content ≤0.7 times the Tar Heavies content of the third mixture, wherein the fifth mixture comprises ≥20.0 wt. % of the hydroprocessed product, based on the weight of the hydroprocessed product.

18. The method of claim 17, wherein the fifth mixture has a density ≥1.00 g/cm$^3$, and comprises ≥50.0 wt. % of multinuclear aromatic molecules.

19. The method of claim 17, wherein the exposing of step (b) is conducted in a pyrolysis furnace that is integrated with a vapor/liquid separation device, and further comprising (i) utilizing the vapor/liquid separation device for separating a bottoms fraction from the first mixture and then combining at least a portion of the fifth mixture with at least a portion of the bottoms fraction and (ii) utilizing at least a portion of the fourth mixture to produce the utility fluid.

20. The method of claim 17, further comprising separating from the fifth mixture high and low-boiling fractions at a cut point in the range of 320° C. to 370° C.

21. The method of claim 20, wherein the cut point is in the range of about 334° C. to about 340° C., and wherein ≥40.0 wt. % of the fifth mixture is contained in the lower-boiling fraction based on the weight of the fifth mixture.

22. The method of claim 17, further comprising hydrogenating at least a portion of the hydroprocessed product, and utilizing at least a portion of the hydrogenated product to produce naphthenic lubricating oil.

23. A hydrocarbon conversion process, comprising:

(a) providing a hydrocarbon mixture comprising ≥1.0 wt. % of $C_2$ unsaturates, and ≥0.1 wt. % of Tar Heavies, the weight percents being based on the weight of the hydrocarbon mixture;

(b) combining the hydrocarbon mixture with a utility fluid to produce a feed mixture, the utility fluid comprising aromatics and having an ASTM D86 10% distillation point ≥60.0° C. and a 90% distillation point ≤350.0° C., wherein the feed mixture comprises 20.0 wt. % to 95.0 wt. % of the hydrocarbon mixture and 5.0 wt. % to 80.0 wt. % of the utility fluid based on the weight of the feed mixture, wherein the utility fluid (i) has a critical temperature in the range of 285° C. to 400° C. and (ii) comprises ≥80.0 wt. % of 1-ring aromatics and/or 2-ring aromatics, including alkyl-functionalized derivatives thereof, based on the weight of the utility fluid;

(c) contacting the feed mixture with at least one hydroprocessing catalyst under catalytic hydroprocessing conditions in the presence of molecular hydrogen to convert at least a portion of the feed mixture to a hydroprocessed product, wherein (i) the hydroprocessed product has a viscosity less than that of the hydrocarbon mixture and (ii) the hydroprocessing has a coke yield ≤0.1 wt. % based on the weight of the feed mixture.

24. The method of claim 23, wherein the utility fluid comprises ≥90.0 wt. % based on the weight of the utility fluid of one or more of benzene, ethylbenzene, trimethylbenzene, xylene, toluene, or methylaphthalenes; and wherein the relative amounts of utility fluid and feed mixture during the hydroprocessing are in the range of 40 wt. % to 90.0 wt. % of the feed mixture and 10.0 wt. % to 60.0 wt. % of the utility fluid, the weight percents being based on the amount of utility fluid and feed mixture present during the hydroprocessing.

* * * * *